US008764494B2

(12) United States Patent
Joseph et al.

(10) Patent No.: US 8,764,494 B2
(45) Date of Patent: Jul. 1, 2014

(54) POWER TERMINAL BLOCK

(71) Applicant: Marathon Special Products, Fort Wayne, IN (US)

(72) Inventors: Brown Joseph, Waterville, OH (US); Brakefield Tim, Perrysburg, OH (US)

(73) Assignee: Marathon Special Products, Beloit, WI (US)

( * ) Notice: Subject to any disclaimer, the term of this patent is extended or adjusted under 35 U.S.C. 154(b) by 34 days.

(21) Appl. No.: 13/645,038

(22) Filed: Oct. 4, 2012

(65) Prior Publication Data

US 2014/0099836 A1 Apr. 10, 2014

(51) Int. Cl.
*H01R 11/09* (2006.01)

(52) U.S. Cl.
USPC ..... 439/798; 439/709

(58) Field of Classification Search
USPC ..... 439/798, 709, 712, 718, 721, 722
See application file for complete search history.

(56) References Cited

U.S. PATENT DOCUMENTS

| | | | | |
|---|---|---|---|---|
| 4,033,663 | A | 7/1977 | McCardell | |
| 4,066,320 | A | 1/1978 | Goodrich et al. | |
| 4,272,147 | A * | 6/1981 | Berglund et al. | 439/92 |
| 4,700,271 | A * | 10/1987 | Iio et al. | 361/638 |
| 5,516,309 | A | 5/1996 | Sayer et al. | |
| 5,941,654 | A * | 8/1999 | Chauquet | 403/384 |
| 6,179,650 | B1 | 1/2001 | Chih-Kai | |
| 6,394,857 | B1 * | 5/2002 | Crochet | 439/721 |
| 6,443,783 | B1 | 9/2002 | Beadle | |
| 6,554,655 | B2 * | 4/2003 | Chadbourne | 439/718 |
| 6,814,628 | B2 * | 11/2004 | Chadbourne | 439/723 |
| 6,902,434 | B2 * | 6/2005 | Stack | 439/620.28 |
| 7,458,861 | B1 * | 12/2008 | Eke et al. | 439/798 |
| 7,578,711 | B2 * | 8/2009 | Robinson | 439/801 |
| 7,978,046 | B2 * | 7/2011 | Ohashi et al. | 337/186 |
| 2011/0173537 | A1 * | 7/2011 | Hemphill | 715/716 |
| 2013/0095696 | A1 * | 4/2013 | Matsumura et al. | 439/620.26 |

* cited by examiner

*Primary Examiner* — Gary Paumen
(74) *Attorney, Agent, or Firm* — Reinhart Boerner Van Deuren s.c.

(57) ABSTRACT

A power terminal block that accommodates busbars with various lengths and terminal positions is provided. The power terminal block includes a pair of insulators and a busbar. Each insulator includes a base, a shelf, and an insulating partition. The shelf is coupled to the base and is configured with a busbar mounting stud. The insulating partition is coupled to the base and the shelf. The busbar is configured to attach to the busbar mounting stud in each insulator. The insulators are spaced apart at a predetermined distance to receive a busbar of any length.

27 Claims, 9 Drawing Sheets

POWER TERMINAL BLOCK

BACKGROUND OF THE INVENTION

The application generally relates to power terminal blocks. More specifically, the application relates to power terminal blocks that can accommodate busbars with varying lengths.

SUMMARY OF THE INVENTION

One embodiment of the invention relates to an infinitely expandable busbar terminal block. The infinitely expandable busbar terminal block includes a pair of insulators and a busbar. Each insulator includes a base, a shelf and an insulating partition. The shelf is coupled to the base. The shelf is configured with a busbar mounting stud. The insulating partition is coupled to the base and the shelf. The busbar is configured to attach to the stud in each insulator. The insulators are in a predetermined spaced apart distance to receive the busbar.

Another embodiment of the invention relates to an infinitely expandable busbar terminal block. The infinitely expandable busbar terminal block includes a pair of insulators and a busbar. Each insulator includes a base, a shelf and an insulating partition. The shelf is coupled to the base. The shelf is configured with a busbar mounting stud. The insulating partition is coupled to the base and the shelf. The shelf includes a busbar pocket between two lateral lands defined on the shelf and the insulating partition. The busbar is configured to attach to the stud in each insulator with the insulators in a predetermined spaced apart distance to receive the busbar.

Another embodiment of the invention relates to an infinitely expandable busbar terminal block. The infinitely expandable busbar terminal block includes a pair of insulators. Each insulator includes a base, a shelf and an insulating partition. The shelf is coupled to the base. The shelf is configured with a busbar mounting stud. The insulating partition is coupled to the base and the shelf. The shelf includes a busbar pocket between two lateral lands defined on the shelf and the insulating partition. Each insulator is configured to receive a busbar configured to attach to the stud in each insulator with the insulators in a predetermined spaced apart distance to receive the busbar.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein the like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
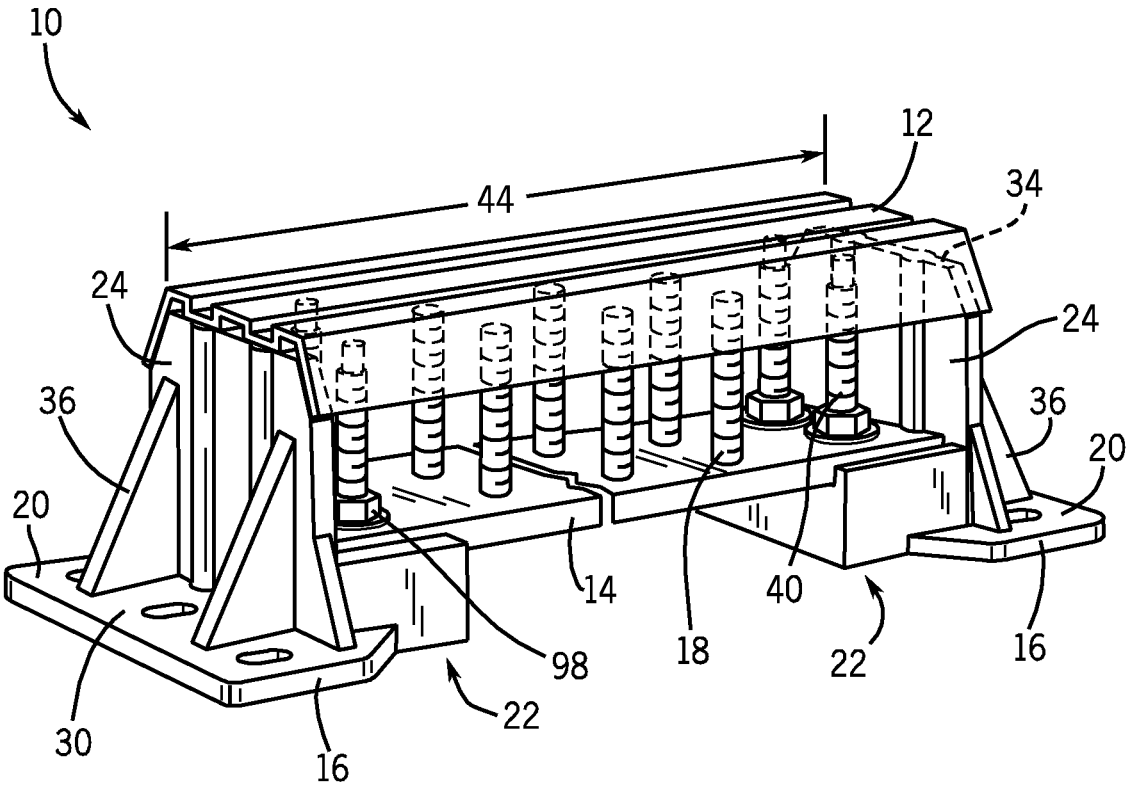
FIG. 1 is a perspective view of the power terminal block according to the exemplary embodiment.

Referring to FIG. 1, a power terminal block 10 has a configuration that accommodates various wire combinations and provides stud termination points on a busbar allowing power distribution among numerous wires. The power terminal block 10 saves the end-user engineering time spent on designing an application specific method to terminate varying wire combinations, as well as time and expenses spent on associated agency approvals.

Referring to FIG. 1, the power terminal block 10 includes a cover 12, a busbar 14 and a pair of insulators 16. Both the cover 12 and the busbar 14 are removable from the pair of insulators 16. The pair of insulators 16 is configured to receive busbars 14 of varying lengths and widths that can accommodate multiple wire termination methods. The busbars 14 also include various amounts of terminal positions 18 located throughout the length of the busbar 14. The flexibility of the length of the busbar 14 and the amount of terminal positions 18 on the busbar 14 provides power terminal block 10 such versatility to allow the user to use pre-attached wire combinations prior to final panel installation. The ability to remove the busbar 14 also allows the product to attach large connectors for bare wire terminations and still have the insulation and maintain the requirements for agency approvals.

Referring to FIG. 1, the pair of insulators 16 both includes a base 20, a shelf 22, and an insulating partition 24 that form a single, integrated insulator member. The pair of insulators 16 can be configured as a single integral unit formed in a molding procedure. The base 20 has an inlet 26 (shown in FIG. 4). The base 20 is coupled to the shelf 22. The inlet 26 has a width and length to receive the shelf 22. The insulating partition 24 is coupled to the top portion 30 of the base 20 and coupled to the back wall portion 32 (shown in FIG. 4) of the shelf 22. The insulating partition 24 is perpendicular with the base 20 forming a 90° right angle. The insulating partition 24 includes an upper edge 34 that is configured to receive the cover 12.

Still Referring to FIG. 1, the pair of insulators 16 also includes at least one support beam 36 that is in a shape of a triangle with a 90° right angle. The right angle of the support beam 36 abuts with the right angle formed between the base 20 and the insulating partition 24. Alternative embodiments may include support beams of different shapes and sizes. For example, the support beam 36 may be more rectangular in shape and extend the entire width of the insulating partition 24 or the base 20.

The exemplary embodiment includes the pair of insulators 16 fabricated, all or in part, of a type of plastic or another composition that does not conduct electricity (e.g., thermoplastic, polyethylene terephthalate, high-density polyethylene, polyvinyl chloride, rubber, wood, etc. or a combination of such materials). Alternative embodiments may have portions of the pair of insulators composed of different materials. For example, the bases 20 of both insulators 16 may be composed of a type of plastic and both shelves 22 may be composed of a type of rubber.

Figure 2:
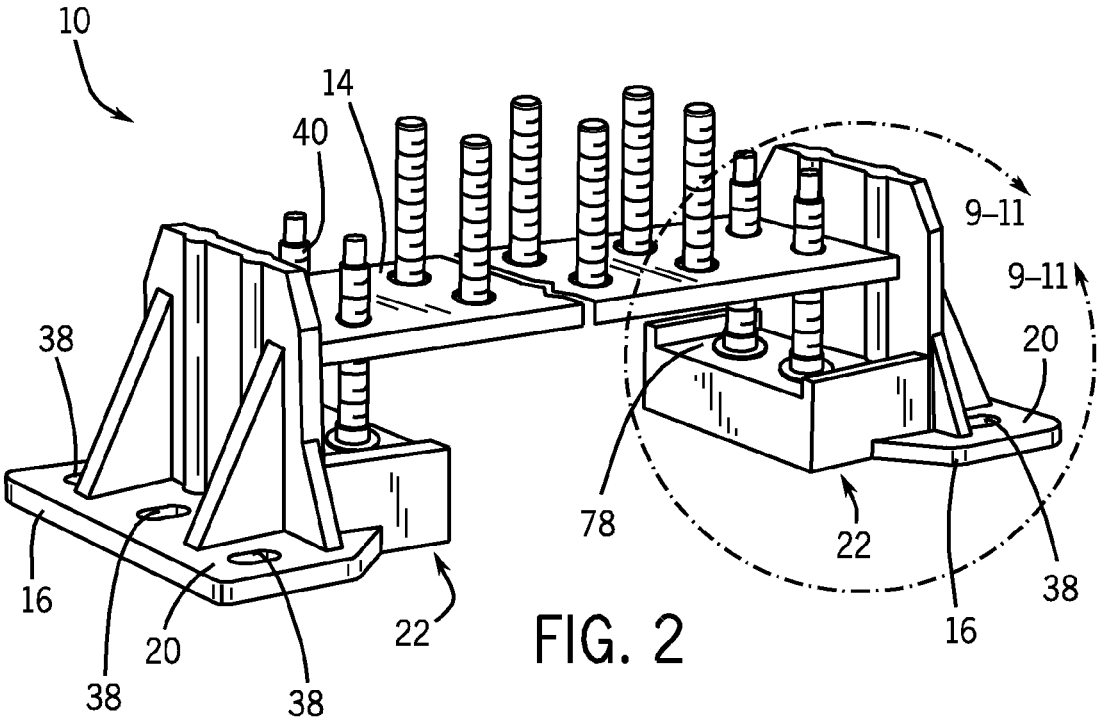
FIG. 2 is a perspective view of the power terminal block according to the exemplary embodiment with the busbar in an upward position.
Figure 3:
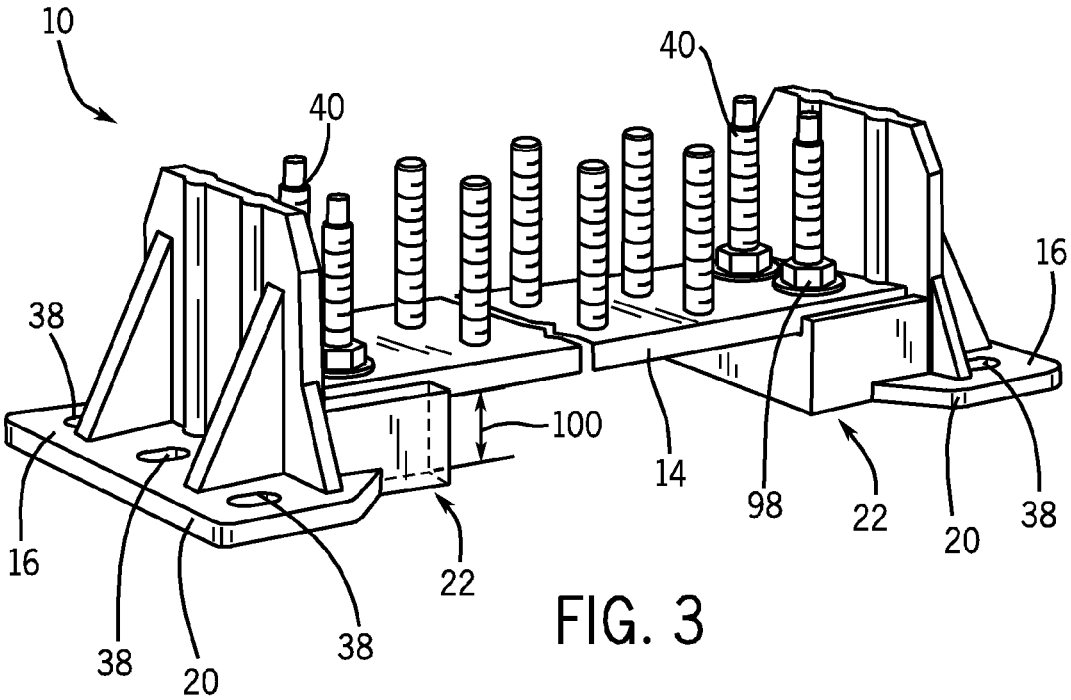
FIG. 3 is a perspective view of the power terminal block according to the exemplary embodiment with the busbar in a downward position.

Referring to FIG. 2 and FIG. 3, the shelves 22 each have at least one mounting stud 40 and each shelf 22 forms a horizontal plane 78. As illustrated in FIG. 2, the busbar mounting studs 40 are located on the horizontal plane 78 formed by the shelves 22. The busbar mounting studs 40 may be of various lengths and diameters to receive a variety of busbars 14. The busbar mounting studs 40 are configured as fastening posts and in one embodiment are molded into the shelves 22 to remain in a stationary position. In another embodiment, the busbar mounting studs 40 are threaded into a socket defined in the shelf 22. The busbar 14 may have a plurality of fastening posts. Each busbar mounting stud 40 configured as a fastening post is suitable to secure a crimp-style wire lug or a flexible strap terminal to the busbar 14 with a fastener 98. For example, the fastener 98 may be a nut or a lock nut. The fastener 98 secures the busbar 14 to the busbar mounting stud 40 to maintain the busbar 14 in a stationary position with the insulating partitions 16. The busbar mounting studs 40 may be fabricated all or in part, of a type of metal (e.g., steel). In the exemplary embodiment, the power terminal block 10 has 2 busbar mounting studs 40 fastened to each insulator 16. Alternative embodiments may include more than 2 busbar mounting studs 40 to accommodate the busbars 14 that are larger in size or less than 2 busbar mounting studs 40 to accommodate the busbars 14 that are smaller in size.

Referring to FIG. 2 and FIG. 3, the base 20 includes oblong base openings 38 configured to allow minor lateral adjustments. The base openings 38 may receive a bolt, screw, or another type of fastening method that is capable of fastening or mounting the power terminal block 10 to a surface (e.g., a wall). Exemplary embodiments include one or more base openings 38. Alternative embodiments may not include any openings in the base 20 or they may include openings that are more circular or square in shape.

Figure 4:
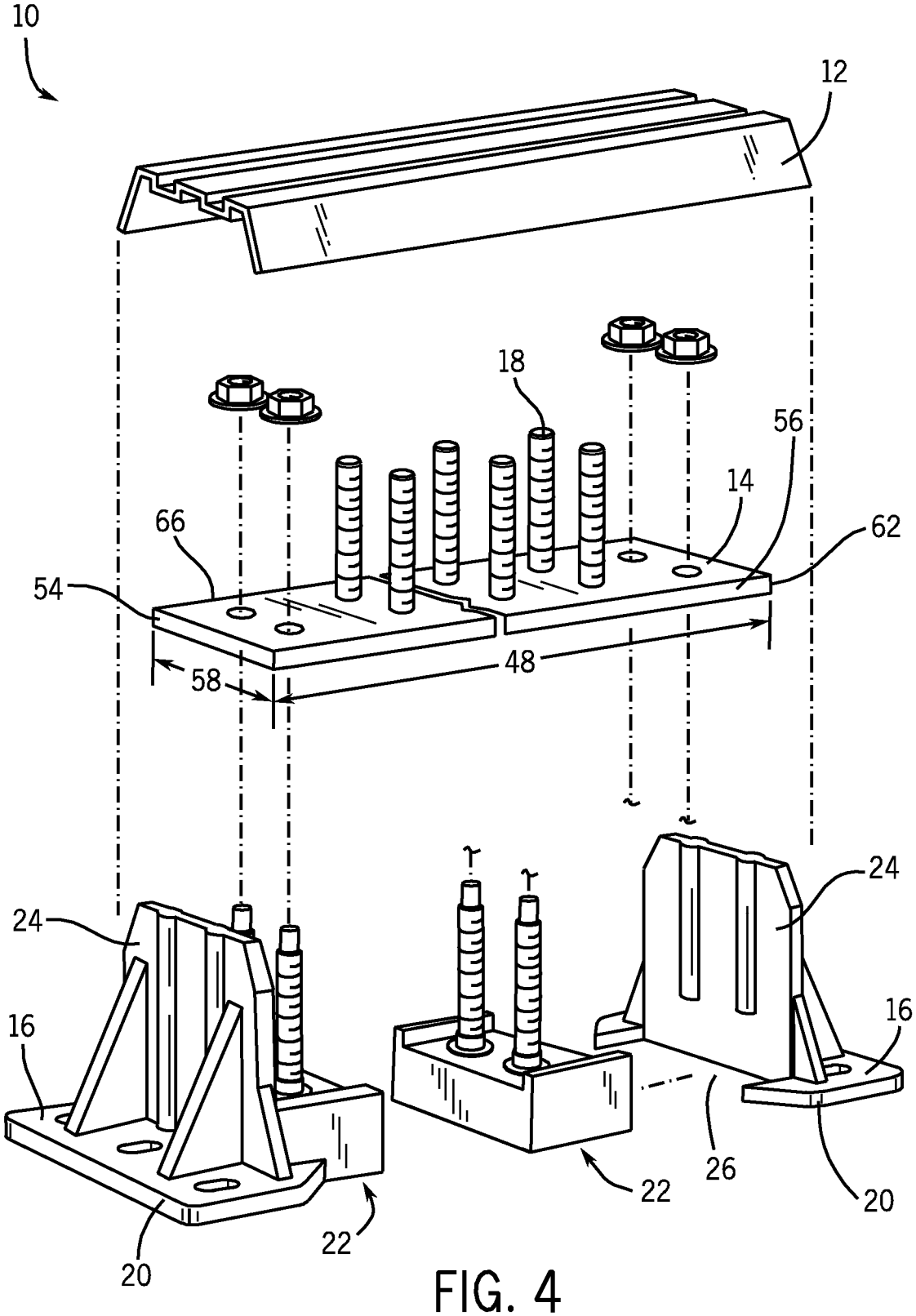
FIG. 4 is an exploded perspective view of the power terminal block according to the exemplary embodiment.
Figure 5:
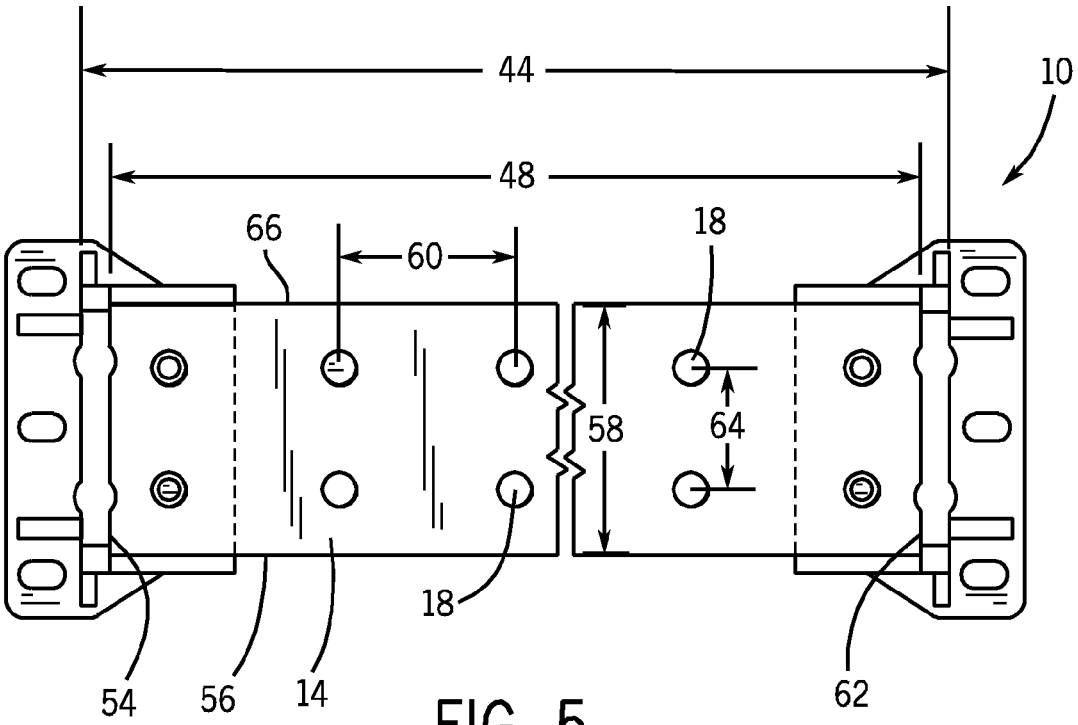
FIG. 5 is a top view of the power terminal block according to the exemplary embodiment.

Referring to FIG. 4 and FIG. 5, the power terminal block 10 includes a busbar 14. The busbar 14 includes a first endwall portion 54 and a second endwall portion 62 and two sidewall portions 56, 66. The busbar 14 has a length 48 extending a predetermined distance between both endwall portions 54, 62. The busbar 14 has a width 58 extending the distance between both sidewall portions 56, 66. The first busbar endwall 54 and the second busbar endwall 62 have the same width 58. The length 48 of the busbar 14 can be any length conceivable located between the pair of insulators 16 that are located at a predetermined spaced apart distance 44. The distance 44 may be any length conceivable to receive the busbar 14 and suitable for the intended installation. For example, the pair of insulators may be located 1 meter from each other and receive a busbar 14 that is 1 meter less 2 times the width of the insulating partitions 24 in length or the pair of insulators may be located 1,000 meters from each other and receive a busbar 14 that is 1,000 meters less 2 times the width of the insulating partition 24 in length.

Referring to FIG. 5, the busbar 14 further includes terminal positions 18. The terminal positions 18 located on the busbar 14 may vary in quantity and size as determined by the user. The terminal positions 18 may be spaced apart from each other at different distances within one busbar 14 or between different busbars 14 of the same length or differing lengths. The terminal positions 18 are spaced apart from each other parallel with the length 48 by a terminal position distance 60 that is the distance between the circumferential center points of two adjacent terminal positions 18. The terminal position distance 60 may be of varying distances between busbars 14 with different lengths 48 or may be varying distances within one busbar 14.

In an exemplary embodiment, the busbar 14 has the length 48 of 1.0 meters and includes three terminal positions 18 laterally located to the sidewall portion 56 or 66 and 2 terminal position distances 60. The terminal position distances 60 in the exemplary embodiment may be the same distance. For example, the two terminal position distances 60 between the three terminal positions 18 may be 0.2 meters. Alternative embodiments may have the busbar 14 having the length 48 of 1.0 meters and includes three terminal positions 18 laterally located to the sidewall portion 56 or 66 that are not evenly spaced apart from each other and have terminal position distances 60 that are not the same distance. For example, the terminal position distance 60 between two of the terminal positions 18 laterally located to the sidewall portion 56 or 66 closest to the endwall 54 may be 0.3 meters and the distance between the two terminal positions 18 laterally located to the sidewall 56 or 66 closest to endwall 62 may be 0.2 meters. Alternative embodiments may include more than or less than three terminal positions 18 laterally located to the sidewall portions 56 and 66 of the busbar 14.

Figure 6:
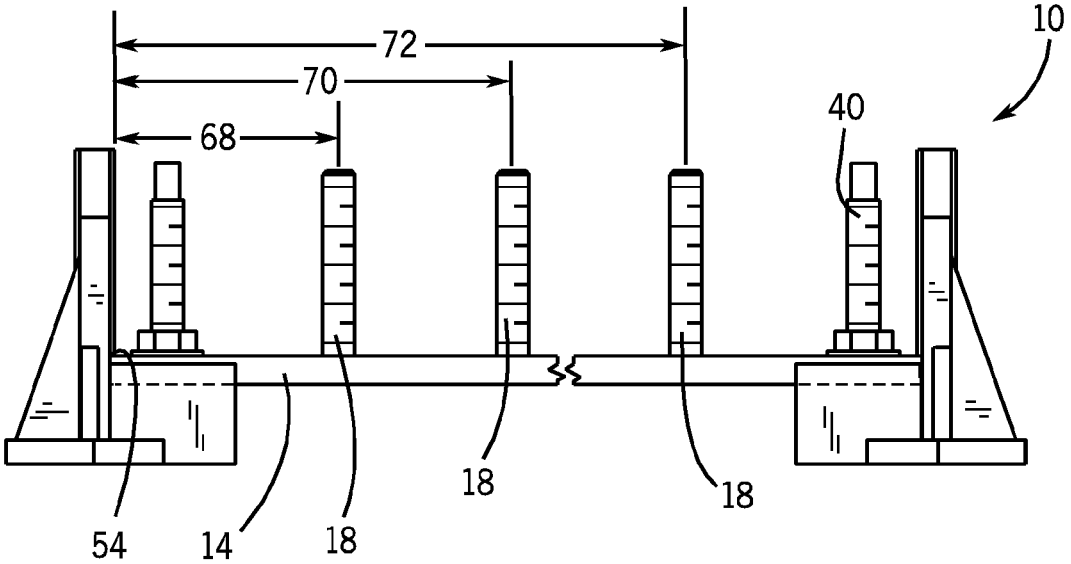
FIG. 6 is a front view of the power terminal block according to the exemplary embodiment.

Referring to FIG. 5 and FIG. 6, the terminal positions 18 may be spaced apart from each other at different distances within one busbar 14 or between different busbars 14 of the same length or differing lengths. The terminal positions 18 are spaced apart from each other parallel with the sidewall width 58 by a terminal position distance 64 that is the distance between the circumferential centerpoints of two adjacent terminal positions 18. The position distance 64 may be of varying distances between busbars 14 with different lengths 48 or may be varying distances within one busbar 14. In the exemplary embodiment, the busbar 14 has the sidewall width 58 and includes six terminal positions 18, three terminal positions laterally located to the sidewall portion 56 and three terminal positions laterally located to the sidewall portion 66. The two terminal positions 18 that are located closest to the endwall 54 are located at a distance 68 from the endwall 54. Therefore, the first set of two terminal positions 18 are located directly across the busbar 14 from each other and have a terminal position distance 64. The second set of two terminal positions 18 are located a distance 70 from the endwall 54. Therefore, the second set of two terminal positions 18 are located directly across the busbar 14 from each other and have a terminal position distance 64. The third set of two terminal positions 18 are located a distance 72 from the endwall 54. Therefore, the third set of terminal positions 18 are located directly across the busbar 14 from each other and have a terminal position distance of 64. For example, the busbar 14 may have a sidewall width 58 of 0.25 meters and the terminal position distance 64 is 0.20 meters, the same between all three sets of terminal positions 18 located on the busbar 14. Alternative embodiments may have terminal position distances 64 that vary on the busbar 14. For example, the terminal position distance 64 in one set of terminal positions 18 may be 0.15 meters and on the same busbar 14 have a second set of terminal positions 18 having a terminal position distance 64 of 0.23 meters.

The design flexibility of the length 48 of the busbar 14 and number of the terminal positions 18 that may be present on the busbar 14 allows the power terminal block 10 to accommodate multiple wire terminations and be infinitely expandable. Therefore, the power terminal block 10 may terminate limitless combinations of wires providing the combination of wires does not exceed the designated amperage for a particular installation.

Figure 9:
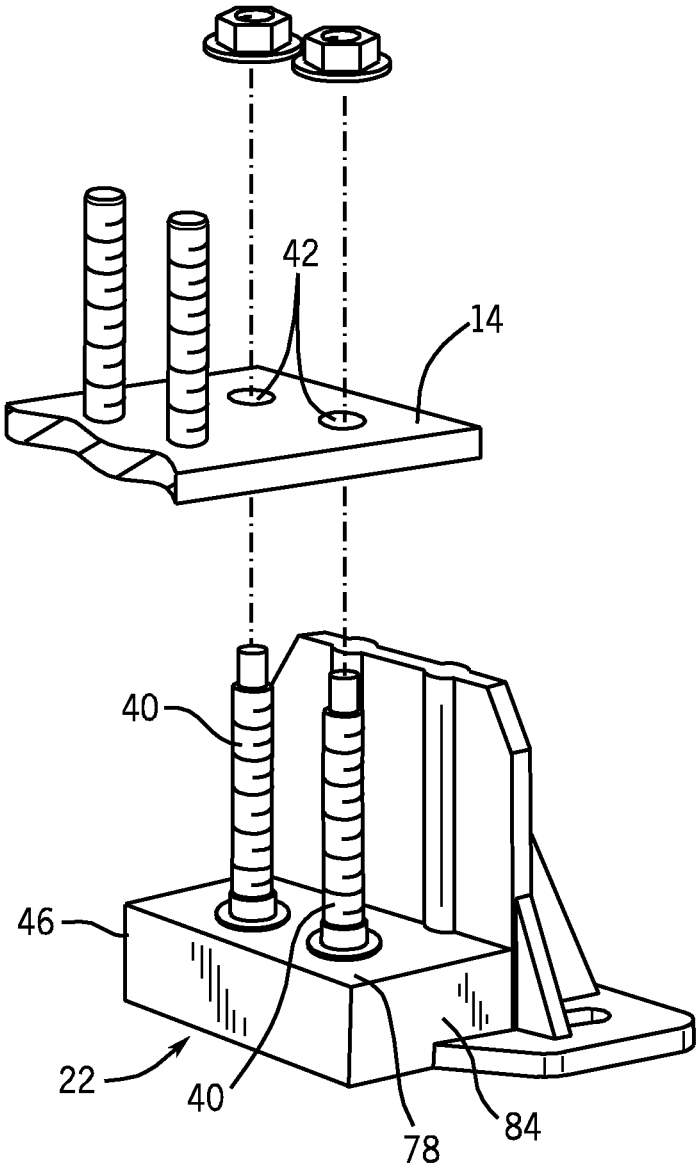
FIG. 9 is a detailed view of the area of the power terminal block insulator labeled as 9-11 in FIG. 2 according to another exemplary embodiment.

Referring to FIG. 9, the busbar 14 also includes openings 42. The openings 42 are configured to permit the busbar mounting studs 40 to pass through the openings 42 of the busbar 14. The busbar 14 may be coupled to the busbar mounting studs 40 by orienting the openings 42 above each of the busbar mounting studs 40. Once the openings 42 and the busbar mounting studs 40 are aligned with each other, the busbar 14 may be lowered for the busbar mounting studs 40 to pass through the openings 42. The exemplary embodiment includes 2 openings 42 to receive 2 busbar mounting studs 40 located on each shelf 22. Alternative embodiments may include less than 2 openings 42 or more than 2 openings 42, which may be determined by the number of busbar mounting studs 40 present on the shelf 22 and the size of the busbar 14.

Referring back to FIG. 2 and FIG. 3, the busbar 14 is lowered in a downward direction along the busbar mounting studs 40 until a portion of the busbar 14 is in contact with a portion of both shelves 22 of the pair of insulators 16. When the busbar 14 is in contact with the shelves 22 and secured to the shelves 22 with the fastener 98, there is a height 100 between the ground and the busbar 14 that allows adequate spacing for proper clearances from the mounting surface to the live components.

Figure 7:
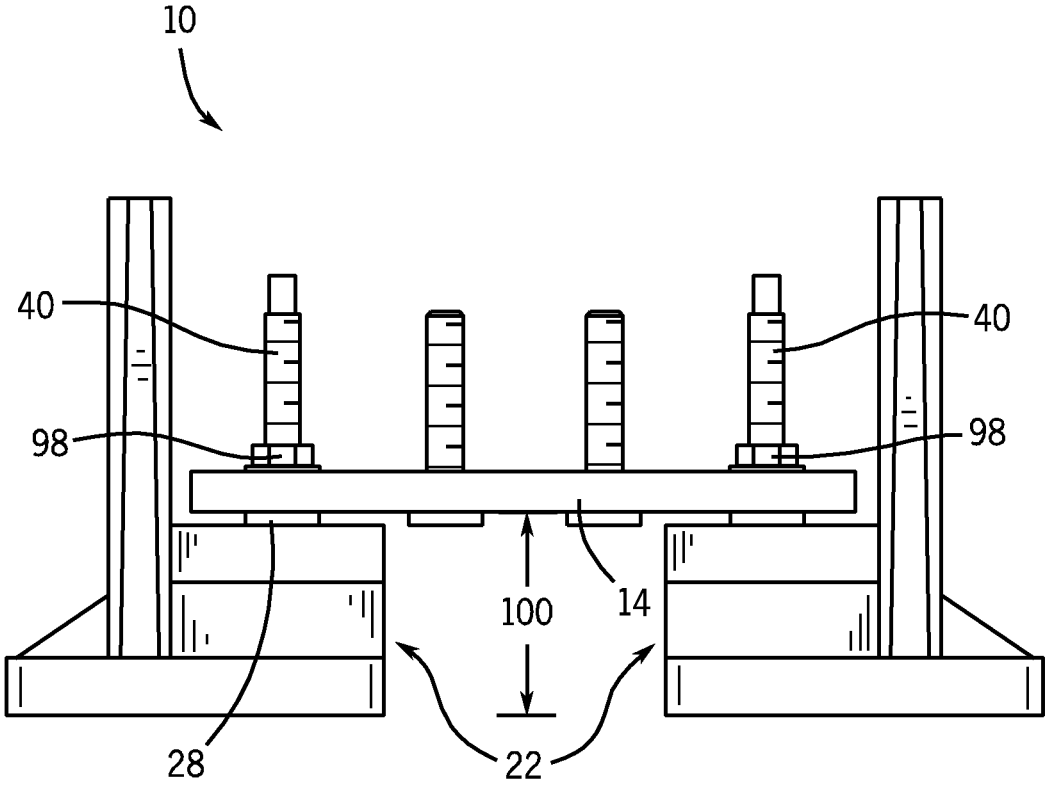
FIG. 7 is a front view of the power terminal block according to another exemplary embodiment.

Referring to FIG. 7, in another exemplary embodiment, the busbar 14 is lowered in a downward direction along the busbar mounting studs 40 until a portion of the busbar 14 is in contact with a landing stud 28. A landing stud 28 is connected to each busbar mounting stud 40 present on the power terminal block 10. In some embodiments, the landing stud 28 is integral with the busbar mounting stud 40. The landing stud 28 provides separation between the busbar 14 and the shelves 22 when the busbar 14 is in the downward position. The fasteners 98 are used to secure the busbar 14 to the busbar mounting studs 40 when the busbar 14 is in the downward position. The height 100 is the length between the ground and the busbar 14 that allows for adequate spacing for proper clearances from the mounting surface to the live components.

Figure 8:
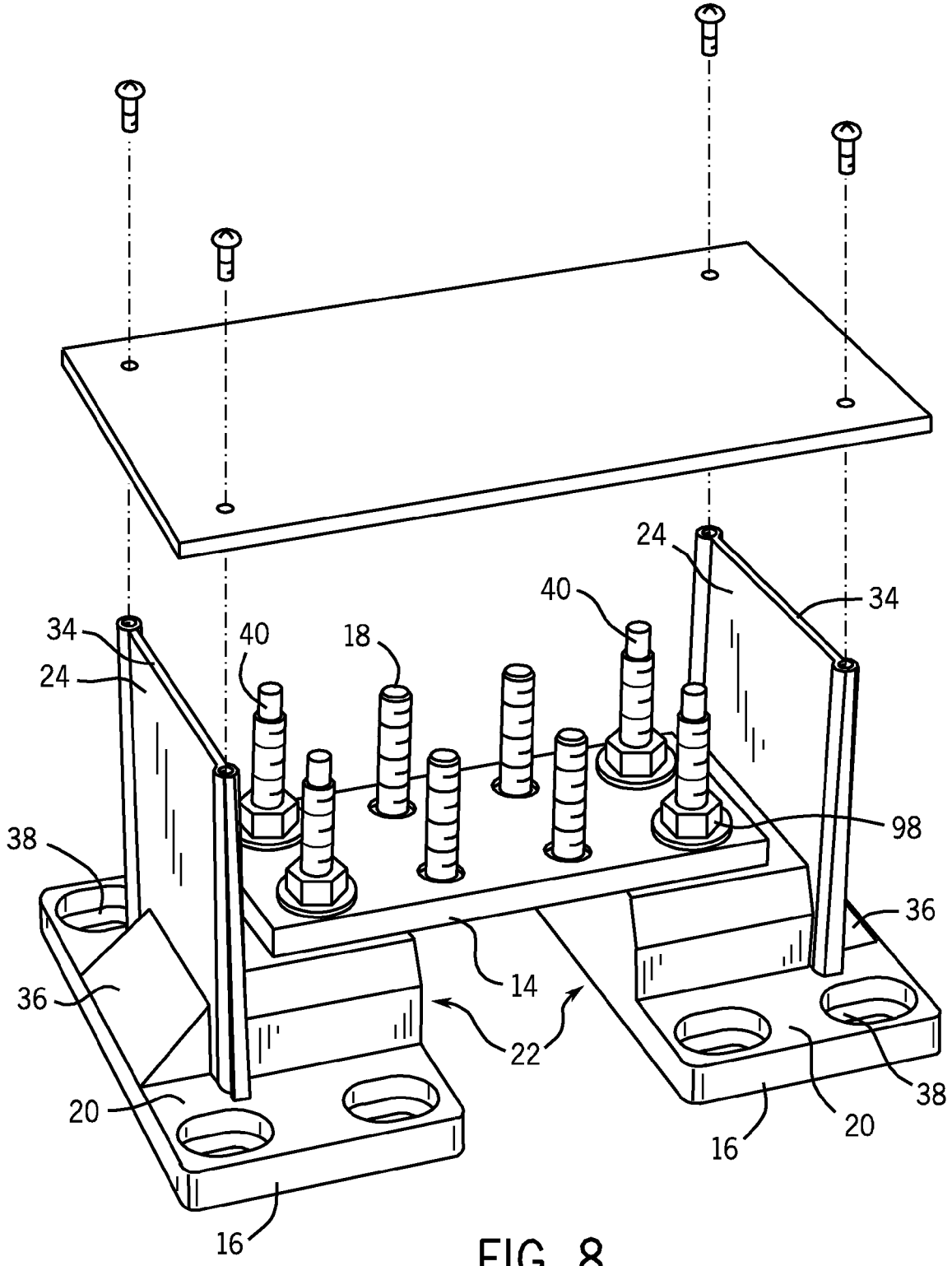
FIG. 8 is a perspective view the power terminal block illustrated in FIG. 7.

Referring to FIG. 8, the cover 12 is configured to couple with the upper edge 34 of both the insulating partitions 24 included in the pair of insulators 16 over the busbar 14 when the busbar 14 is secured to the busbar mounting studs 40 with fasteners 98. In the exemplary embodiment, the cover 12 may be secured to the upper edges 34 of the insulation partitions 24 with a type of screw, bolt or another type of fastening method that is capable of fastening or securing the cover 12 to the insulating partitions 24. The cover 12 is composed of a suitable insulating material and may be transparent or opaque. In alternative embodiments, the cover 12 may be different shapes, sizes and dimensions (see FIG. 1 and FIG. 4) in order to couple to the upper edges 34 of insulation partitions 24 of different sizes and spaced apart distances.

The busbar 14 may then be removed from the pair of insulators 16 by moving the busbar 14 in an upward direction along the busbar mounting studs 40 when the cover 12 is removed from the insulation partition upper edges 34 and the fasteners 98 are removed from the busbar mounting studs 40. In the exemplary embodiment, a busbar 14 of one length may be removed from a pair of insulators 16 and a busbar 14 of a different length may be placed on the same pair of insulators 16 that are placed at a predetermined spaced apart distance 44 to receive the busbar 14. For example, a terminal block 10 may have a pair of insulators 16 spaced apart at 1.0 meters to receive a busbar 14 that is less than 0.8 meters in length. The same terminal power block 10 may have the same pair of insulators 16 spaced apart at a greater length to receive (e.g., 2.0 meters) a busbar 14 that is greater than 0.8 meters in length.

Referring to FIG. 9, the shelf 22 includes a first outside sidewall portion 46, the horizontal plane 78 and a second outside sidewall portion 84. The first outside sidewall portion 46 and the horizontal plane 78 form a 90° angle. The horizontal plane extends to the second outside sidewall portion 84. The horizontal plane 78 and the second outside sidewall portion 84 form a 90° angle. In the exemplary embodiment, the busbar 14 in the downward position contacts the horizontal plane 78 directly.

Figure 10:
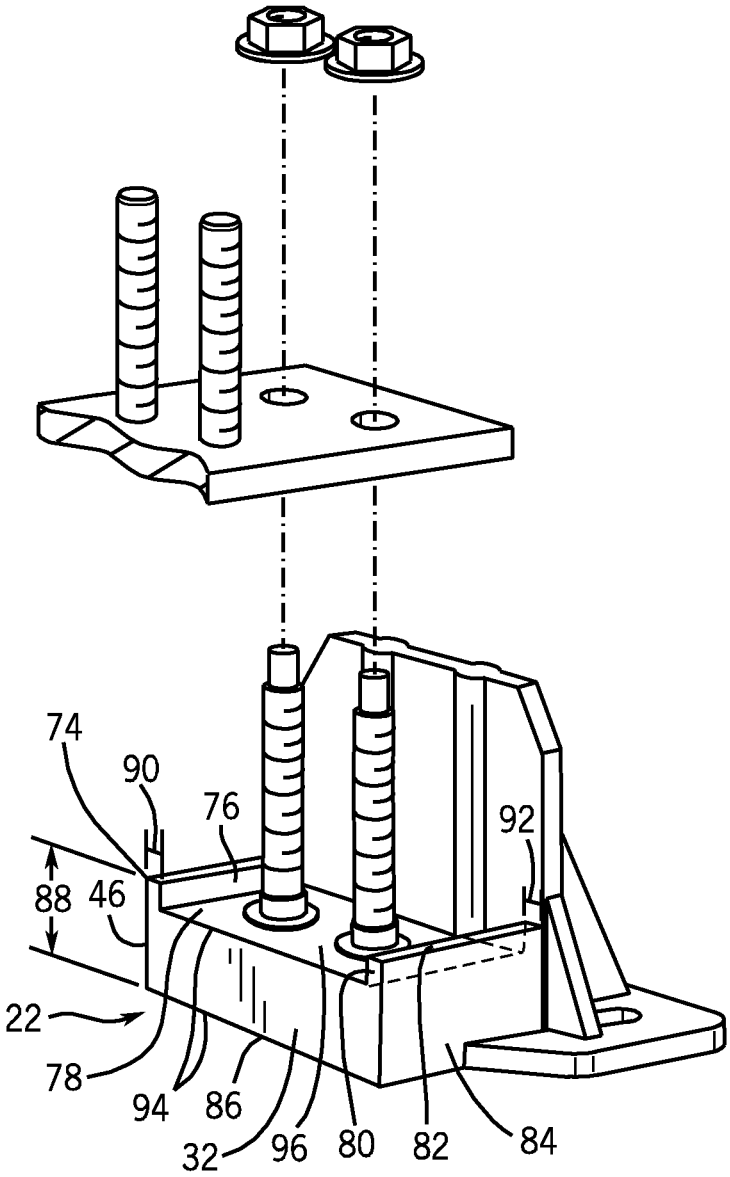
FIG. 10 is a detailed view of the area of the power terminal block insulator labeled as 9-11 in FIG. 2 according to the exemplary embodiment.

Referring to FIG. 10, the exemplary embodiment includes the shelves 22 that form a pocket 96. The pocket 96 is the area where shelves 22 receive the busbar 14 when the busbar 14 is in the downward position. The pocket 96 is defined by the first outside sidewall portion 46, a first top edge 74, a first interior surface 76, the horizontal plane 78, a second interior surface 80, a second top edge 82, the second outside sidewall portion 84, a bottom edge 86, the back wall portion 32 (shown in FIG. 4) and a front wall portion 102. The first outside sidewall portion 46 and the second outside sidewall portion 84 have a height 88 that is the distance between the first top edge 74 and the bottom edge 86 and the second top edge 82 and the bottom edge 86, respectively. The first outside sidewall portion 46 is adjacent to the first top edge 74. The first top edge 74 has a length 90 extending from the first outside sidewall portion 46 to the first interior surface 76. The first interior surface 76 extends in the downward direction from the first top edge 74 towards the horizontal plane 78. The first interior surface 76 and the horizontal plane 78 form a 90° angle. The horizontal plane 78 extends to the second interior surface 80. The horizontal plane 78 and the second interior surface 80 form a 90° angle. The second interior surface 80 extends in an upward direction from the horizontal plane 78 to the second top edge 82. The second top edge has a length 92 extending from the second interior surface 80 to the second outside sidewall portion 84. The second outside sidewall portion 84 is adjacent to the second top edge 82. The pocket 96 has a height that is the distance from the bottom edge 86 to the horizontal plane 78. The height 88 of the first outside sidewall portion 46 and the second outside sidewall portion 84 is greater than the height between the bottom edge 86 and the horizontal plane 78. The pocket 96 is formed from the shelves 22 with varying heights.

Figure 11:
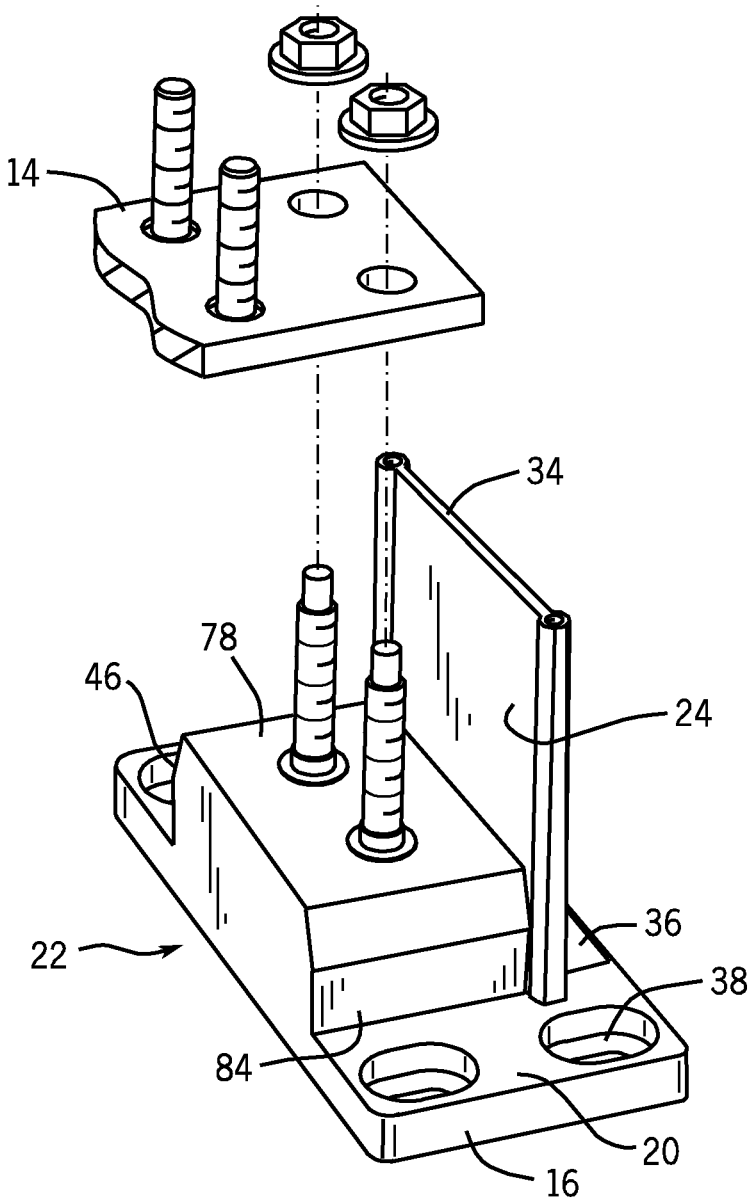
FIG. 11 is a detailed view of the area of the power terminal block insulator labeled as 9-11 in FIG. 2 according to another exemplary embodiment.

Referring to FIG. 11, the shelves 22 of another exemplary embodiment include the first outside sidewall portion 46, the first top edge 74, the horizontal plane 78, the second top edge 82 and the second outside sidewall portion 84. A portion of both the first outside sidewall portion 46 and the second outside sidewall portion 84 are sloped in order to facilitate a molding process. In the exemplary embodiment, the first outside wall portion 46 and the second outside wall portion 84 extend upwards from the top portion 30 towards the horizontal plane 78 and slope inwardly towards each other at the midpoint of both the first outside sidewall portion 46 and the second outside sidewall portion 84. The first outside sidewall portion 46 and the second outside sidewall 84 in alternative embodiments may be sloped at different degrees and angles in order to facilitate a variety of molds and processes.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

What is claimed is:

1. An infinitely expandable busbar terminal block comprising:

a pair of insulators, with each insulator comprising:

a base;

a shelf coupled to the base, with the shelf configured with a busbar mounting stud; and an insulating partition coupled to the base and the shelf; and a busbar configured to attach to the stud in each insulator with the busbar including a plurality of spaced apart fastening posts each configured to receive a nut at a distal end of the fastening post, and with the insulators in a predetermined spaced apart distance to receive the busbar.

2. The infinitely expandable busbar terminal block of claim 1, further comprising the base, shelf, and partition are a single, integral insulator member.

3. The infinitely expandable busbar terminal block of claim 1, with at least one additional mounting stud in the shelf.

4. The infinitely expandable busbar terminal block of claim 1, with the mounting stud configured as a fastening post.

5. The infinitely expandable busbar terminal block of claim 1, with the mounting stud molded in the shelf.

6. The infinitely expandable busbar terminal block of claim 1, with the mounting stud threaded into the shelf.

7. The infinitely expandable busbar terminal block of claim 1, with a portion of the busbar in contact with the shelf of each insulator.

8. The infinitely expandable busbar terminal block of claim 1, with each fastening post suitable to secure one of a crimp-style wire lug and a flexible busbar, with a fastener.

9. The infinitely expandable busbar terminal block of claim 1, further comprising a cover configured to couple with each insulator over the busbar.

10. An infinitely expandable busbar terminal block comprising:

a pair of insulators, with each insulator comprising:

a base;

a shelf coupled to the base, with the shelf configured with a busbar mounting stud; and an insulating partition coupled to the base and the shelf with the shelf including a busbar pocket between two lateral lands defined on the shelf and the insulating partition;

and a busbar configured to attach to the stud in each insulator with the insulators in a predetermined spaced apart distance to receive the busbar, the busbar configured with a plurality of spaced apart fastening posts each configured to receive a nut at a distal end of the fastening post.

11. The infinitely expandable busbar terminal block of claim 10, further comprising the base, shelf, and partition are a single, integral member.

12. The infinitely expandable busbar terminal block of claim 10, with at least one additional mounting stud in the shelf.

13. The infinitely expandable busbar terminal block of claim 10, with the mounting stud configured as a fastening post.

14. The infinitely expandable busbar terminal block of claim 10, with the mounting stud molded in the shelf.

15. The infinitely expandable busbar terminal block of claim 10, with the mounting stud threaded into the shelf.

16. The infinitely expandable busbar terminal block of claim 10, with a portion of the busbar in contact with the busbar pocket of the shelf of each insulator.

17. The infinitely expandable busbar terminal block of claim 10, with each fastening post suitable to secure one of a crimp-style wire lug and a flexible busbar, with a fastener.

18. The infinitely expandable busbar terminal block of claim 10, further comprising a cover configured to couple with each insulator over the busbar.

19. An infinitely expandable busbar terminal block comprising:

a pair of insulators, with each insulator comprising:

a base;

a shelf coupled to the base, with the shelf configured with a busbar mounting stud; and an insulating partition coupled to the base and the shelf with the shelf including a busbar pocket between two lateral lands defined on the shelf and the insulating partition, with each insulator configured to receive a busbar configured with a plurality of spaced apart fastening posts each configured to receive a nut at a distal end of the fastening post and the busbar configured to attach to the stud in each insulator with the insulators in a predetermined spaced apart distance to receive the busbar.

20. The infinitely expandable busbar terminal block of claim 19, further comprising the base, shelf, and partition are a single, integral member.

21. The infinitely expandable busbar terminal block of claim 19, with at least one additional mounting stud in the shelf.

22. The infinitely expandable busbar terminal block of claim 19, with the mounting stud configured as a fastening post.

23. The infinitely expandable busbar terminal block of claim 19, with the mounting stud molded in the shelf.

24. The infinitely expandable busbar terminal block of claim 19, with the mounting stud threaded into the shelf.

25. The infinitely expandable busbar terminal block of claim 19, with a portion of the busbar in contact with the busbar pocket of the shelf of each insulator.

26. The infinitely expandable busbar terminal block of claim 19, with each fastening post suitable to secure one of a crimp-style wire lug and a flexible busbar, with a fastener.

27. The infinitely expandable busbar terminal block of claim 19, further comprising a cover configured to couple with each insulator over the busbar.

* * * * *